United States Patent [19]

Engalitcheff, Jr.

[11] 4,337,050

[45] Jun. 29, 1982

[54] METHOD AND APPARATUS FOR REHABILITATION OF DAMAGED LIMBS

[75] Inventor: John Engalitcheff, Jr., Gibson Island, Md.

[73] Assignee: Baltimore Therapeutic Equipment Company, Baltimore, Md.

[21] Appl. No.: 99,838

[22] Filed: Dec. 3, 1979

[51] Int. Cl.[3] ..... A63B 21/24

[52] U.S. Cl. ..... 434/260; 272/129; 272/130; 272/132; 434/219; 434/62

[58] Field of Search ..... 272/130, 140, 67, 129, 272/136, 68, 131, 143, 134, 132; 434/219, 258, 61, 62, 260, 29; 128/25 R

[56] References Cited

U.S. PATENT DOCUMENTS

| | | | |
|---|---|---|---|
| 336,216 | 2/1886 | Debuysere . | |
| 2,777,439 | 1/1957 | Tuttle | 128/25 R |
| 2,921,791 | 1/1960 | Berne | 272/117 |
| 3,103,357 | 9/1963 | Berne | 272/132 |
| 3,212,776 | 10/1965 | Bassler | 272/73 |
| 3,465,592 | 9/1969 | Perrine | 272/130 |
| 3,495,824 | 2/1970 | Cunier | 272/134 |
| 3,516,661 | 6/1970 | Hansen . | |
| 3,618,595 | 11/1971 | Stahmer . | |
| 3,647,210 | 3/1972 | Ratcliffe | 272/140 X |
| 3,744,480 | 7/1973 | Gause . | |
| 3,756,222 | 9/1973 | Ketchum . | |
| 3,784,194 | 1/1974 | Perrine | 272/125 |
| 3,848,467 | 11/1974 | Flavell . | |
| 3,939,580 | 2/1976 | Nakano . | |
| 4,166,327 | 9/1979 | Wressell . | |

OTHER PUBLICATIONS

Athletic Journal, p. 89, May 1980.

Elliott, Assessing Muscle Strength Isokenetically Jama, vol. 240, No. 22, pp. 2408–2409, 11/24/78.

Moffroid and Whipple, Specificity of Speed of Exercise, Partial Adaptation from Master of Arts Thesis for N.Y.U.

Cybex II Advertisements.

Cybex II Dual-Channel System Advertisement.

"Cybex Times", and Personal Fitness Record, Published by Lumex, Inc. Bayshore, N.Y., 1978.

Orthotron Advertisement 1978 Lumex Inc., Bayshore, N.Y. 1978.

Pipes Strength-Training Modes: What's the Difference Scholastic Coach, vol. 46, No. 10, May/Jun. 1977.

Bell, Yankee Pedalers, Gentlemens Quaterly 1976 Esquire, Inc.

Bibliography of Iso Kinetic Research Clinical Study & Observation, Compiled by Cybex.

Cybex II Inversion/Eversion Adapter & Leg Stabilization Frame Advertisement.

Kinetron Advertisement of Lumex Inc. 1979, Bayshore, N.Y.

Cybex Digital Work Integrator.

Fitron Cycle Work Integrator, Advertisement of Cybex.

Lesmes Costill, Coyle, and Fink, "Muscle Strength and Power Changes During Maximal Isokenetic Training", Medicine and Science in Sports Journal, vol. 10, No. 4, pp. 266–269, 1978.

Pes Anserinus Transfer: an in Viso Biochemical Analysis, American Journal of Sports Medicine, vol. 5, No. 5, pp. 204–208, 1977.

Groin Strain Injuries in Ice Hockey, Journal of Sports Medicine, pp. 41–42, 1973.

*Primary Examiner*—Richard J. Johnson

*Attorney, Agent, or Firm*—Haight, Noble & Mendelsohn

[57] ABSTRACT

A method and apparatus for the rehabilitation of damaged limbs for use in the operation of a tool wherein accessories with handles corresponding to the handles of familiar tools are attached to a shaft in a manner such that the movements of the handle corresponding to the normal operatin of the tool product rotation of a shaft. A preselected resistance is applied to the rotation of the shaft by electrical, pneumatic, hydraulic, or mechanical means, and the resistance and the accessory attached can be varied in accordance with the capability of the damaged limb.

6 Claims, 23 Drawing Figures

54
20
66
44
70
20
22
28
20
18
24
54
10
12
16
14

Fig.14.
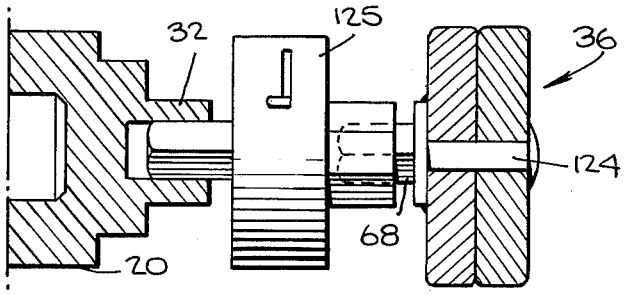
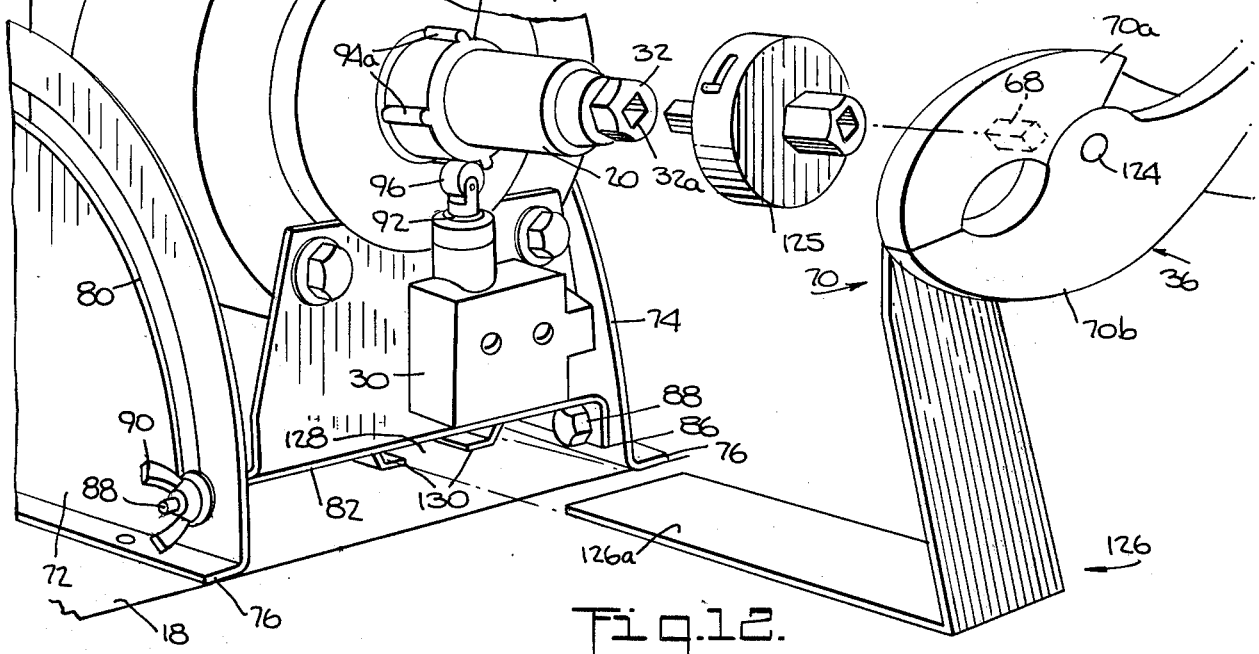
Fig.12.
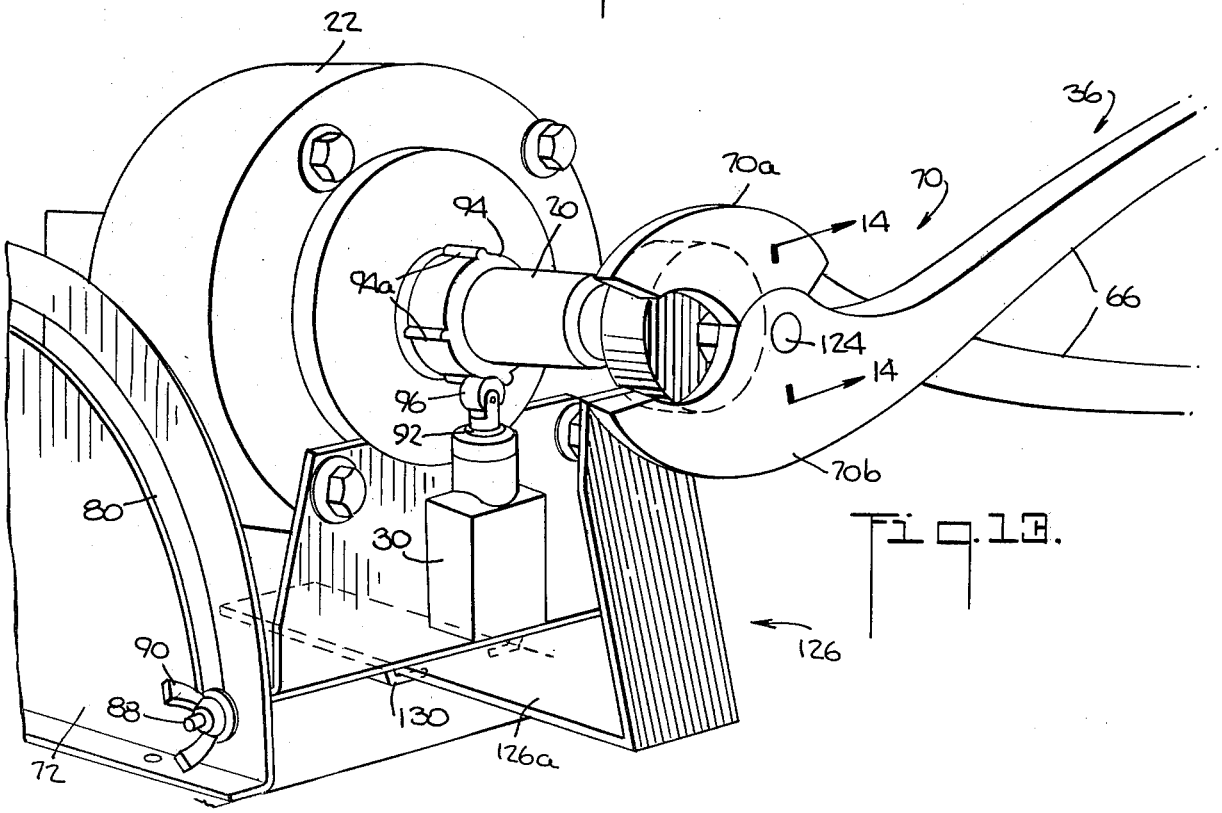
Fig.13.

Fig. 16.
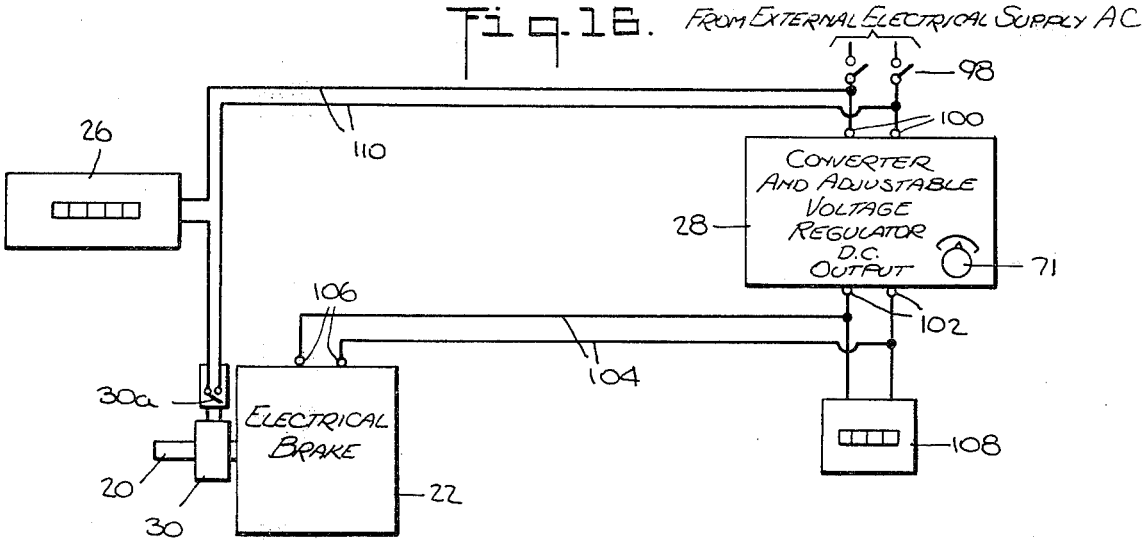
Fig. 17.
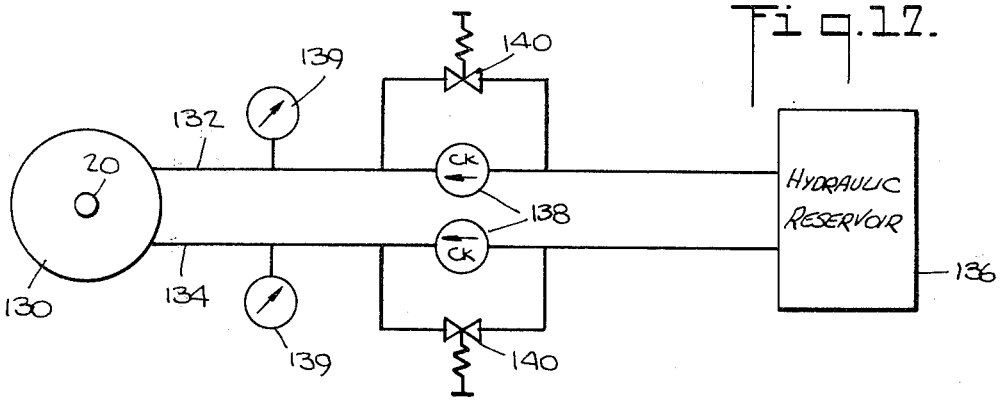
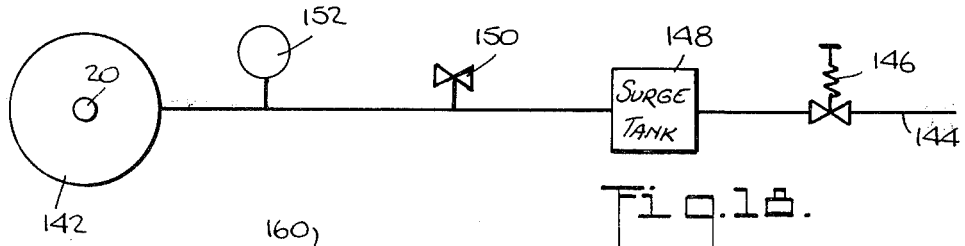
Fig. 18.
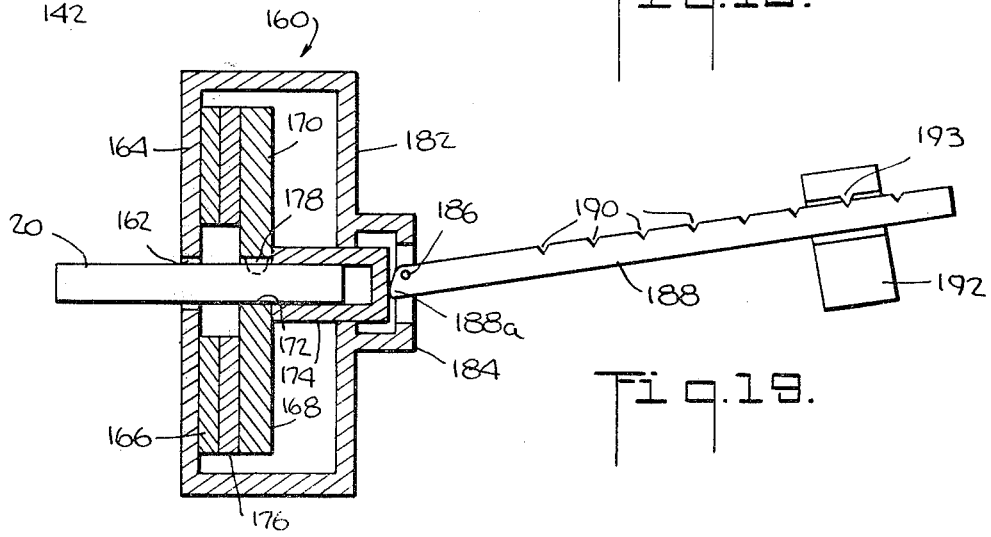
Fig. 19.

METHOD AND APPARATUS FOR REHABILITATION OF DAMAGED LIMBS

BACKGROUND OF THE INVENTION

1. Field of the Invention

This invention relates to the rehabilitation of damaged limbs, and more specifically it concerns novel methods and apparatus for exercising the muscles and joints of damaged limbs in a manner particularly well suited to restoration of their ability to perform useful work.

2. Description of the Prior Art

People who have had injuries to limbs often undergo a program of physical rehabilitation therapy in an effort to regain their lost capabilities. The term "rehabilitation" as used herein is meant to encompass both the diagnostic and revivicative aspects of therapy.

This program of rehabilitation, besides including treatment by massage, bath, and electricity, often also included the use of machines to strengthen muscles through exercise. Such exercising machines are disclosed for example in U.S. Pat. Nos. 2,777,439, 3,103,357, and 3,495,824.

These exercise machines comprised a moveable element which was pushed, pulled or turned in a specific direction by the patient. A resistance, such as a spring, weight or brake was connected to the moveable element to provide a controlled amount of reaction force.

While exercise machines enabled one to strengthen specific muscles, their limited, stylized movements did not permit the kind of therapy that was usually needed to enable the patient to return to his previous trade or occupation which often involved a complex combination of limb movements carried out in a coordinated fashion. For example, the motions required to saw a board, to operate a drill press and to drive a vehicle require the simultaneous coordinated movements of several muscles and joints with different muscles being put under different stresses at different times. While it may be possible for one to strengthen wrist movements in a specific direction using a prior art exercise machine and to strengthen forearm movements in a specific direction on another exercise machine, this does not mean that the patient after having received therapy on these machines can then perform an operation which requires coordinated wrist and forearm movements such as take place when operating a wrench.

In dealing with this problem, physical therapists attempted to reestablish the work situation to which the patients would be exposed upon their discharge by the simulation in the hospital of actual job activities. Various tools such as lathes and drill presses were provided to aid in rehabilitation. This scheme had the disadvantage that the patient could practice only on the particular type of machine that was available in the hospital. Since space limitations prevented the introduction of every kind of mechanical apparatus encountered in the real world into a hospital workshop, this scheme had limited utility. Moreover, it was expensive to provide these machines for the patients and, in some cases, dangerous for the patients to practice on them as well.

SUMMARY OF THE INVENTION

The present invention overcomes the above-described shortcomings of the prior art. In one aspect of the invention, this is achieved by simulating a work environment by providing an accessory with a handle or handles corresponding to the handle or handles of a tool being simulated. The accessory is attached to a rotatable shaft in a manner such that when the handle or handles are moved in the path followed in the normal operation of the tool being simulated, the accessory turns the shaft. The shaft in turn is coupled to an adjustable brake to provide a predetermined resistance to turning. The accessory provides the patient with the "feel" of the tool to which he has been accustomed; and the movements of the accessory are such that the patient can effectively carry out the coordinated muscle and joint movements needed for effective therapy. The braking resistance may be varied so that the rehabilitation program can be carried out according to the specific needs and the progress of the individual patient. In addition, the accessory may be replaced with a different accessory having a different size handle as rehabilitation progresses.

In another aspect the present invention provides novel apparatus for simulating the operation characteristics of different tools for the rehabilitation of damaged limbs. This novel apparatus comprises a plurality of accessories, each accessory having at least one handle of the size and shape of the handle of a tool being simulated. The accessory also includes a coupler element and frame means which interconnect the handle to the coupler element in a manner such that movement of the handle through the path of movement of the handle of the tool being simulated produces rotation of the coupler element. A shaft is mounted for full rotation about a fixed axis and a brake is arranged to produce a predetermined resistance to rotation of the shaft. A cooperative accessory coupler is arranged on one end of the shaft to receive the coupler elements of the accessories to support the accessories and to communicate their movements to the shaft. Means may also be provided to adjust the resistance provided by the brake. As will be seen more fully hereinafter, the novel apparatus of this invention permits a hospital or other rehabilitation center to simulate the operation characteristics of many different types of tools in an inexpensive, yet controllable and safe manner.

The arrangements of the present invention provide a novel technique of diagnosis of limb injuries. More specifically, the present invention permits a patient to perform arm and hand movements in which several muscles and joints must move in a coordinated fashion. Often pain or incapacity is not experienced when these muscles and joints are exercised individually. By providing arrangements where the different muscles and joints are exercised in different combinations it becomes possible for a therapist to ascertain quite quickly and precisely just where a particular injury is located.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A preferred embodiment of the invention has been chosen for purposes of illustration and description, and is shown in the accompanying drawings, forming a part of the specification, wherein:

FIG. 12 is a view similar to FIG. 2 but showing a pliers simulating accessory about to be connected to a brake controlled shaft;

FIG. 13 is a view similar to FIG. 12 but showing the pliers simulating accessory connected to the brake controlled shaft;

FIG. 14 is a section view taken along line 14—14 of FIG. 13;

FIG. 16 is a wiring diagram for the embodiment of FIG. 1;

FIG. 17 is a schematic diagram for a hydraulically operated shaft control brake for use in the embodiment of FIG. 1;

FIG. 18 is a schematic diagram for a pneumatically operated shaft control brake for use in the embodiment of FIG. 1;

FIG. 19 is a side elevational view, partially in section, of a mechanically operated shaft control brake for use in the embodiment of FIG. 1;

DETAILED DESCRIPTION OF THE PREFERRED EMBODIMENT

Figure 1:
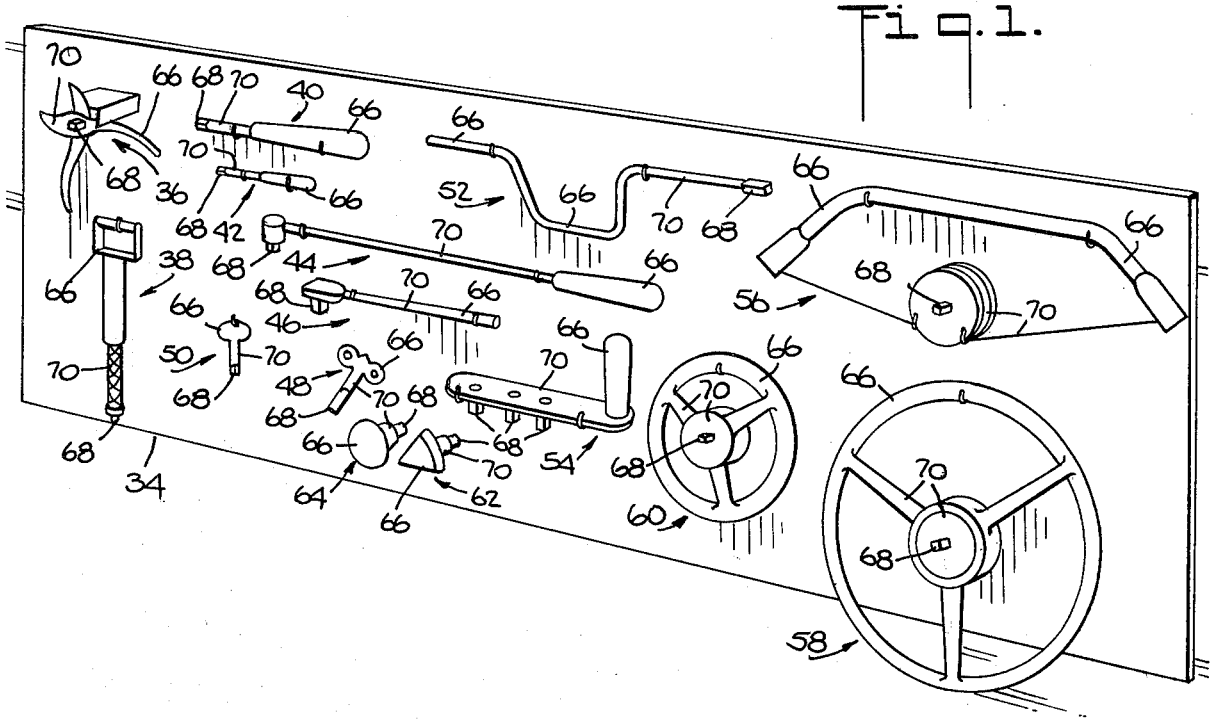
FIG. 1 is a perspective view of a rehabilitative apparatus embodying the present invention.
Figure 1:
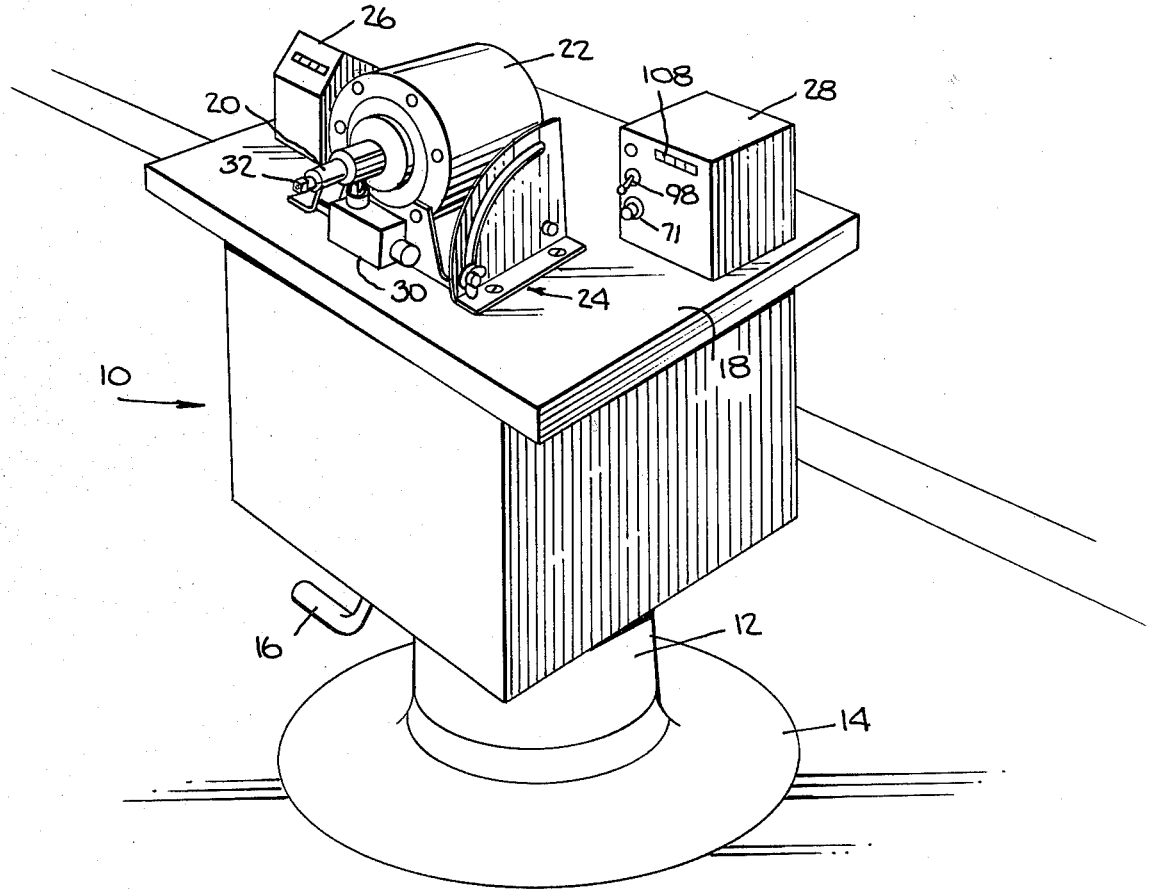

As embodied in FIG. 1, the rehabilitative device of the present invention includes a table 10 mounted, by means of an extendable trunk 12, to a fixed base 14. The table 10 may be elevated and lowered in the manner of a dentist's chair by operation of a crank 16 extending out from the bottom of the table. The table 10 also may be pivoted about a vertical axis to any desired position.

The table 10 has a top 18 on which a brake controlled shaft 20 is mounted. The shaft 20 extends from an electrical brake 22 which in turn is mounted in an adjustable bracket assembly 24. The bracket assembly is bolted to the table top 18. A shaft rotation register 26 and a brake resistance control 28, in the form of an A-C to D-C converter and adjustable voltage regulator, are also mounted on the table top 18. The shaft rotation register is connected to a shaft rotation sensing assembly 30 in front of the brake 22. An accessory coupler 32 is arranged on the end of the shaft 20 which projects out from the brake 22 just beyond the edge of the table top 18.

An accessory board 34 is located near the table 10 and a plurality of tool simulating accessories are removeably mounted on the board 34. These tool simulating accessories include a pliers type squeezing accessory 36 and a push tool accessory 38, large and small screwdriver accessories 40 and 42, large and small one-hand wrench accessories 44 and 46, large and small key accessories 48 and 50, a two-hand crank wrench accessory 52, a multiple radius crank arm accessory 54, a saw accessory 56, large and small wheel accessories 58 and 60 and triangular and round knob accessories 62 and 64. Each accessory has at least one handle portion 66, a cooperative coupler element 68 and a frame 70 interconnecting the handle and coupler element in a manner such that movement of the handle or handles through the path of movement of the tool being simulated produces rotation of the coupler element 68. The coupler element 68 on each accessory is removeably connectable to the accessory coupler 32 in the manner of a socket wrench tool to its handle. In this way the accessory becomes supported on the brake controlled shaft 20 and when the accessory handle or handles 66 are moved to turn the coupler element 68. This turns the shaft 20 against the resistance imparted by the electrical brake 22. The amount of resistance offered by the brake 22 is controlled by operation of an adjustment knob 71 or the brake resistance control 28.

Figure 2:
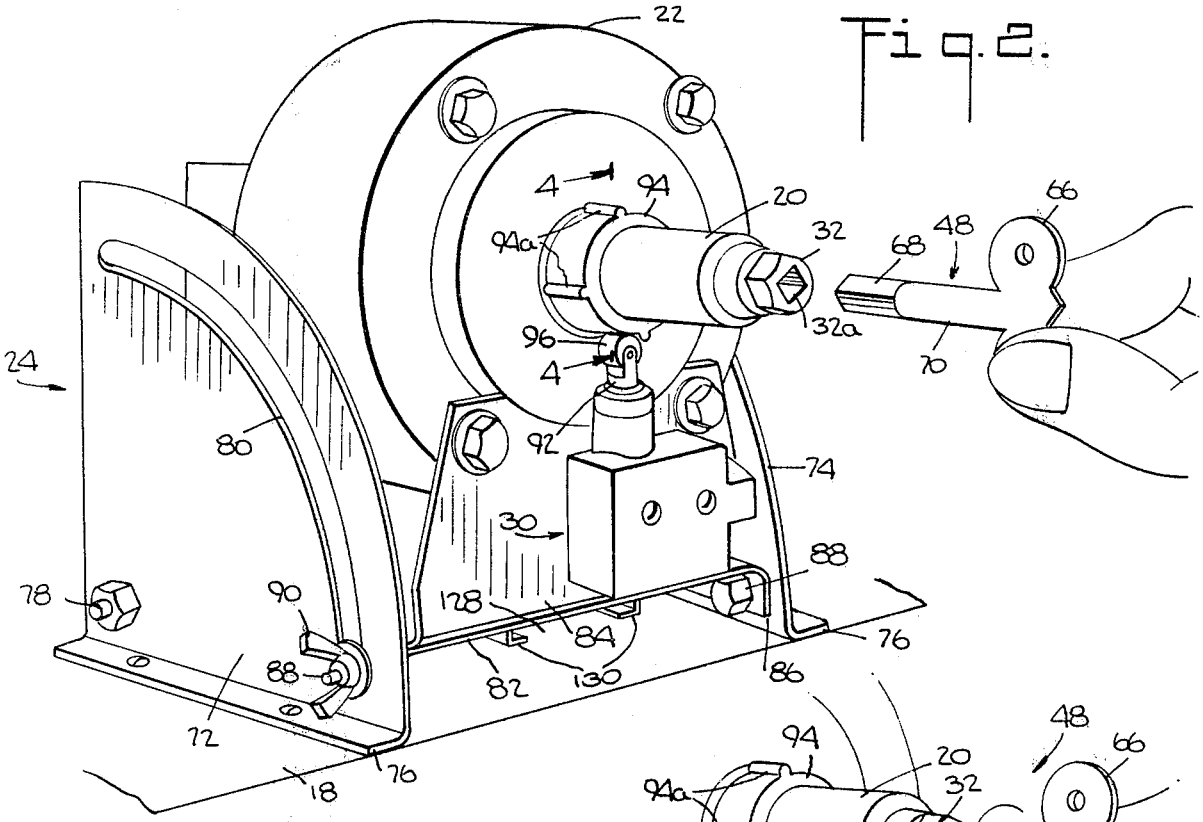
FIG. 2 is a fragmentary perspective view of the embodiment of FIG. 1, showing a key simulating accessory about to be connected to a brake controlled shaft.
Figure 3:
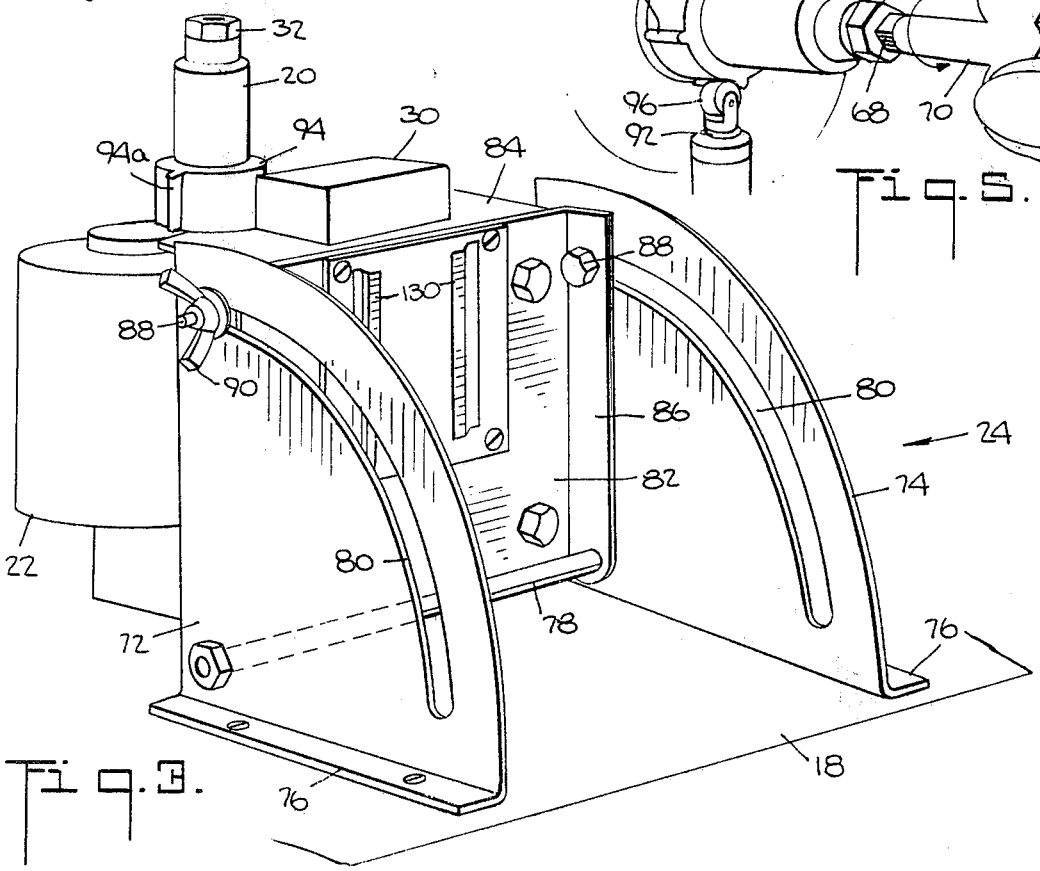
FIG. 3 is a view similar to FIG. 2 showing the brake controlled shaft adjusted to a different position.

The construction of the adjustable bracket assembly 24 which mounts the electrical brake 22 to the table top 18 is best shown in FIGS. 2 and 3. As can be seen the bracket assembly 24 comprises a pair of spaced apart upwardly extending side plates 72 and 74 having flanges 76 along their lower edge which rest against and are bolted or welded to the table top 18. An elongated pivot rod 78 extends between the side plates 72 and 74 parallel to the table top and near the bottom of one vertical edge of the plates. Each plate is also formed with a curved slot 80 near its opposite edge and the curvature of the slots 80 is coaxial with the pivot rod 78.

A brake support bracket 82 extends under the brake 22 and this bracket has upwardly extending front and rear flanges (only the front flange 84 being shown) which are bolted to the front and back of the brake. As shown in FIG. 3, the bottom of the bracket 82 is also bolted to the bottom of the brake. The brake support bracket 82 also includes a pair of downwardly extending side flanges 86 which fit closely but loosely between the side plates 72 and 74. The pivot rod 78 extends through the side flanges 86 near one end thereof. Near the other end of the side flanges 86 there are provided bolts 88 which extend through the curved slots 80 in the side plates. Wing nuts 90 are provided on the outwardly projecting ends of the bolts 88.

It will be seen from the foregoing that the brake 22 and the shaft 20 may be adjusted at any position between horizontal and vertical by loosening the wing nuts 90 and tilting the brake 22 with its bracket 82 around the pivot rod 78. The wing nuts may then be tightened to clamp the flanges 86 of the bracket 82 to the side plates 72 and 74 and hold the entire assembly in the position to which it has been adjusted.

The electrical brake 22 may be any electrical braking device which can be adjusted, for example by adjustment of an applied voltage, to produce a predetermined torque resistance to rotation of the shaft 22. Such brakes are well known and an example of a suitable brake is that known as Electro Module Brake Model EM-50-20, Model EM-180-20 or Model EM-210-20 available from the Warner Electric Brake & Clutch Company of Beloit, Wis. The voltage which controls the torque resistance provided by the brake 22, as indicated above, is applied from the brake resistance control 28 (see FIG. 1) which, as previously indicated, comprises an A-C to D-C converter and an adjustable voltage regulator. The output of the control 28 is a D-C voltage whose amplitude is adjusted by turning a knob 71. The amount of this voltage is indicated by a voltage meter 108.

Figure 4:
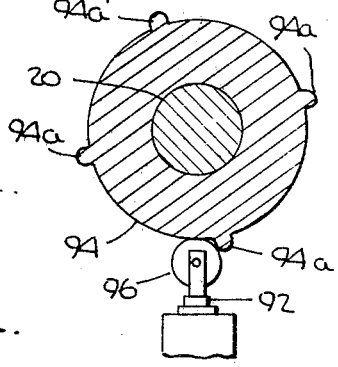
FIG. 4 is a section view taken along line 4—4 of FIG. 2.

As shown in FIG. 2, the shaft rotation sensing assembly 30 is mounted on the front flange 84 of the brake support bracket 82 just under the brake controlled shaft 20. The shaft rotation sensing assembly is basically an electrical switch which is activated by depression of a switch arm 92 which projects out of the assembly up toward the shaft 20. A collar 94 is fixed to the shaft 20 to turn with it and this collar is formed with projections **94*a* which, as the collar turns, engage and depress a roller 96 on the end of the switch arm 92 to produce switching in the shaft rotation sensing assembly 30. This engagement and depression of the roller 96 by the collar projections 94*a* is best seen in FIG. 4**.

The electrical connections for the brake 22, the brake resistance control 28, the shaft rotation sensing assembly 30 and the shaft rotation register 26 are shown in FIG. 16. As can be seen, A-C (alternating current) electrical power from an external source (not shown) is applied via a master switch 98 to input terminals 100 of the brake resistance control, 28, where it is converted to D-C (direct current) and is adjustably regulated as to voltage according to the setting of the adjustment knob 71. The selected direct current voltage appears at output terminals 102 of the brake resistance control and this voltage is supplied along a line 104 to input terminals 106 of the electrical brake 22. The voltmeter 108 is also connected to the line 104 to register the voltage applied to the brake 22 and hence the amount of torque resistance it is applying to the brake controlled shaft 20.

The electrical voltage from the master switch 98 is also supplied along a shaft rotation register line 110 to the shaft rotation register 26 and a switch **30*a* activated by the shaft rotation sensing assembly 30 when the brake controlled shaft 20 turns. Each time the switch 30*a* closes and opens a pulse is applied to the shaft rotation register 26 and a count is recorded in the register. The register is preferably provided with a digital readout to indicate the total amount the shaft 20** has been turned during a particular exercise routine.

Operation of the rehabilitation device described above is illustrated in FIGS. 2 and 5 which show the device in use with the large key accessory 48. As can be seen in these drawings, the handle 66 of the key accessory is of the same size and shape as that of a regular key used, for example, to wind a clock. The frame 70 of the accessory connects the handle 66 to the coupler element 68 in such a way that the path of movement followed by the handle 66 when one winds a clock produces rotation of the coupler element 68.

Figure 5:
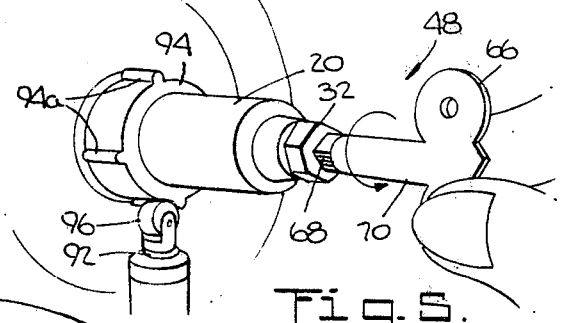
FIG. 5 is a view in detail of FIG. 2 showing the key simulating accessory connected to the brake controlled shaft.

The coupler element 68, as shown in FIGS. 2 and 5, comprises a square shaped projection which fits into a square shaped recess **32*a* (shown in FIG. 2) in the accessory coupler 32 to transfer its rotation to the brake controlled shaft 20**.

The adjustment knob 71 (FIGS. 1 and 16) is then set to produce a predetermined indication of torque resistance on the shaft 20 and the patient then attempts to turn the key accessory handle 66 as illustrated in FIG. 5. As the handle is turned the shaft rotation sensing assembly 30 is activated as described above and the amount of rotation is recorded on the shaft rotation register 26.

The amount of torque resistance applied to the shaft 20 is indicated by the voltmeter 108. Since each tool simulating accessory may require a different torque resistance, calibration charts (not shown) may be provided so that one using a specific accessory may ascertain from a chart previously made up for that accessory, what brake voltage will produce a given resistance to movement of the accessory. The user then moves the adjustment knob 71 until the voltmeter 108 indicates that voltage.

Figure 6:
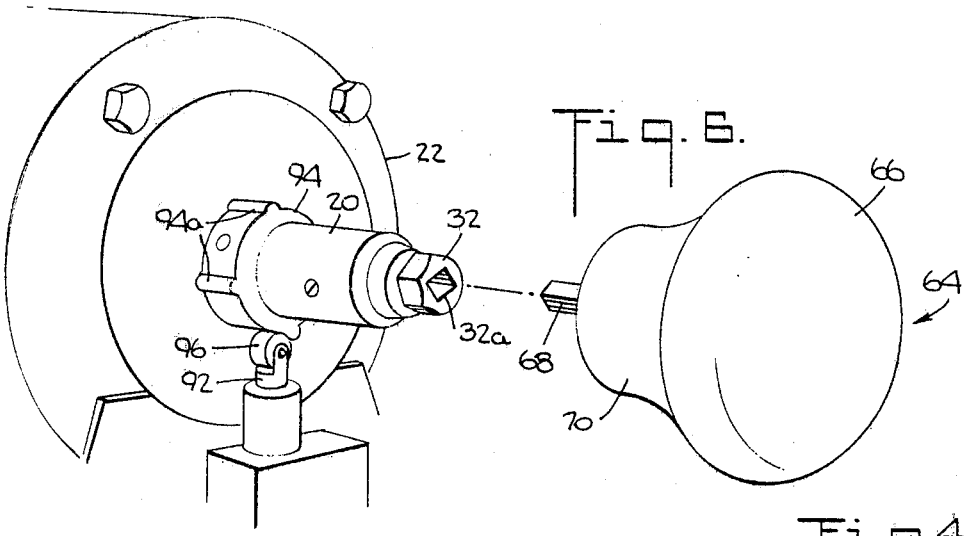
FIG. 6 is a view similar to FIG. 2 but showing a knob simulating accessory.

FIG. 6 illustrates the operation of the rehabilitation device as used with the round knob accessory 64. As can be seen, the handle 66 of this accessory is connected by its frame 70 to the coupler element 68 such that operation of the knob handle causes the coupler element to turn. This turning is communicated from the coupler element 68 via the accessory coupler 32 to the brake controlled shaft 20.

Figure 7:
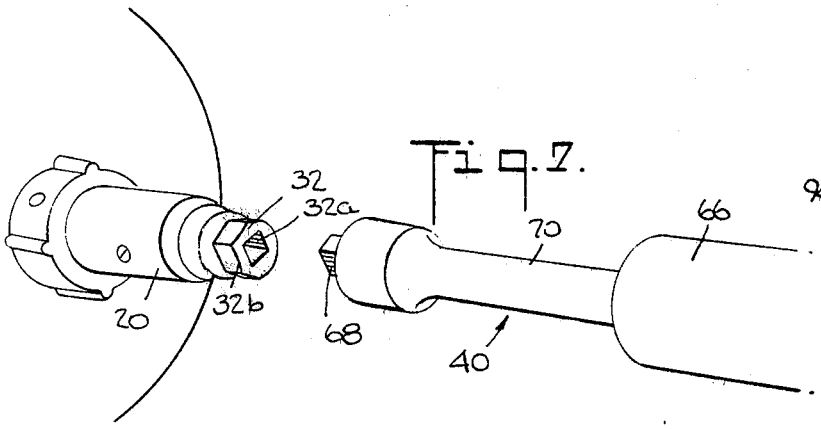
FIG. 7 is a view similar to FIG. 2 but showing a screwdriver simulating assembly.

FIG. 7 illustrates the operation of the rehabilitation device as used with the large screwdriver accessory 40. Here also a screwdriver handle 66 is connected via a frame 70 to a coupler element 68 such that ordinary movements of the handle 66 corresponding to operation of a screwdriver are caused to turn the coupler element 66.

Figure 8:
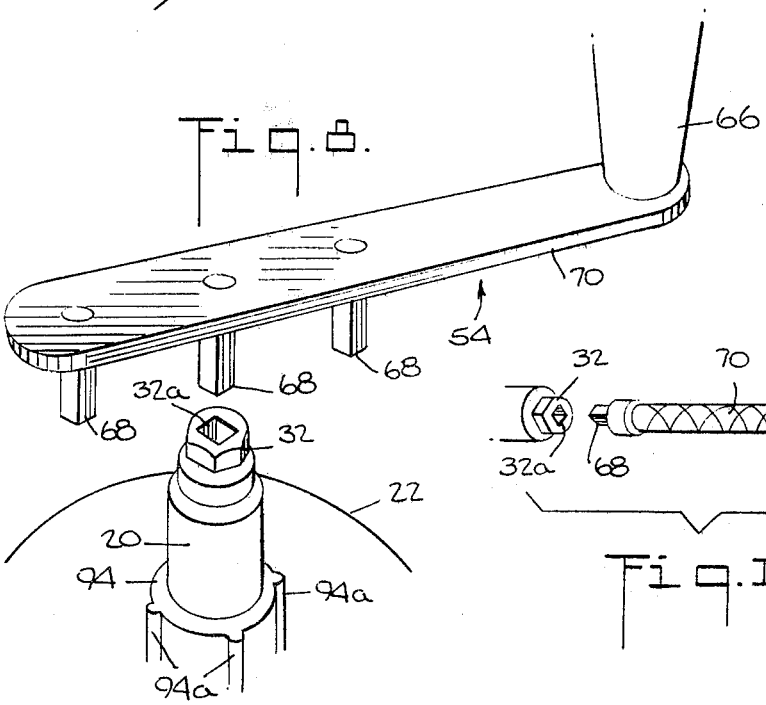
FIG. 8 is a further fragmentary view of a portion of FIG. 3 and showing a multiple radius crank arm accessory about to be connected to a brake controlled shaft.

FIG. 8 illustrates operation of the rehabilitation device as used with the multiple radius crank arm accessory 54. As can be seen in FIG. 8 the crank arm accessory 54 comprises a handle 66 which is interconnected by a frame 70 to several coupler elements 68 in such a way that cranking movements of the handle through different arc radii cause rotation of different ones of the coupler elements. Any of the coupler elements 68 can be connected to the accessory coupler 32 to simulate the operation of cranks of different crank arm length.

Figure 9:
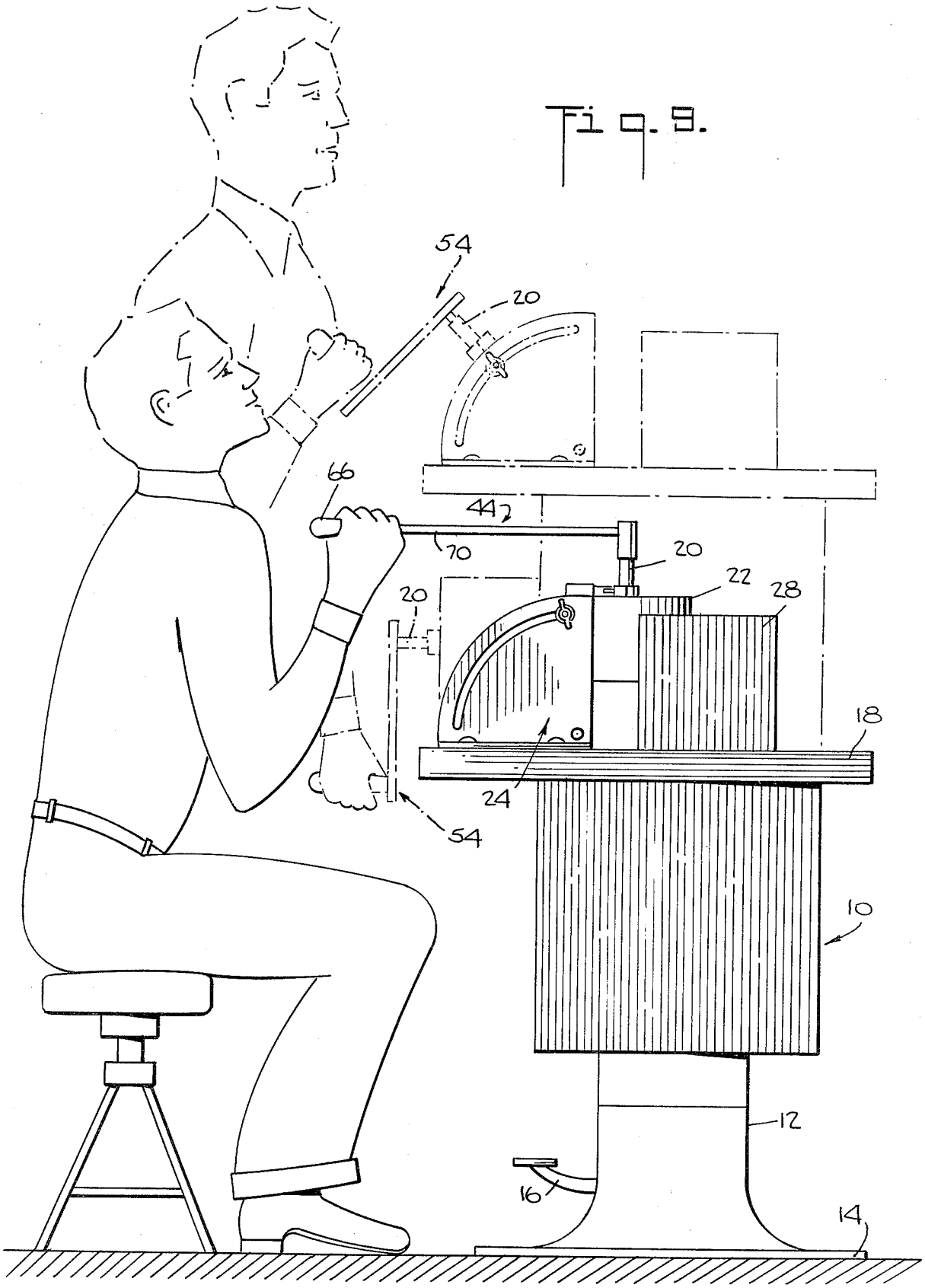
FIG. 9 is a side elevational view of the embodiment of FIG. 1 and further showing, in phantom outline, various positions to which the embodiment may be adjusted.

FIG. 9 illustrates the adjustment of the table 10 in height from a lower position (solid outline) to an upper position (phantom outline) and the angular adjustment of the brake controlled shaft. This arrangement considerably extends the range of available tool simulation. For example, with the table 10 in its lowered position and the brake controlled shaft 20 set to a vertical position (as shown in solid outline), the large one hand wrench accessory 44 may be used by a seated patient to simulate the use of a wrench for loosening or tightening a bolt, for example. Also, by adjusting the brake controlled shaft 20 to a horizontal direction and using the multiple radius crank arm accessory 54 (lower phantom outline) the device may be used to simulate a lathe feed control for a seated patient. Further, with the table 10 in its upper position and the brake controlled shaft adjusted to an inclined direction the multiple radius crank arm accessory 54 (upper phantom outline) may be used to simulate a brake arm lever of a vehicle such as a train or subway.

Figure 10:
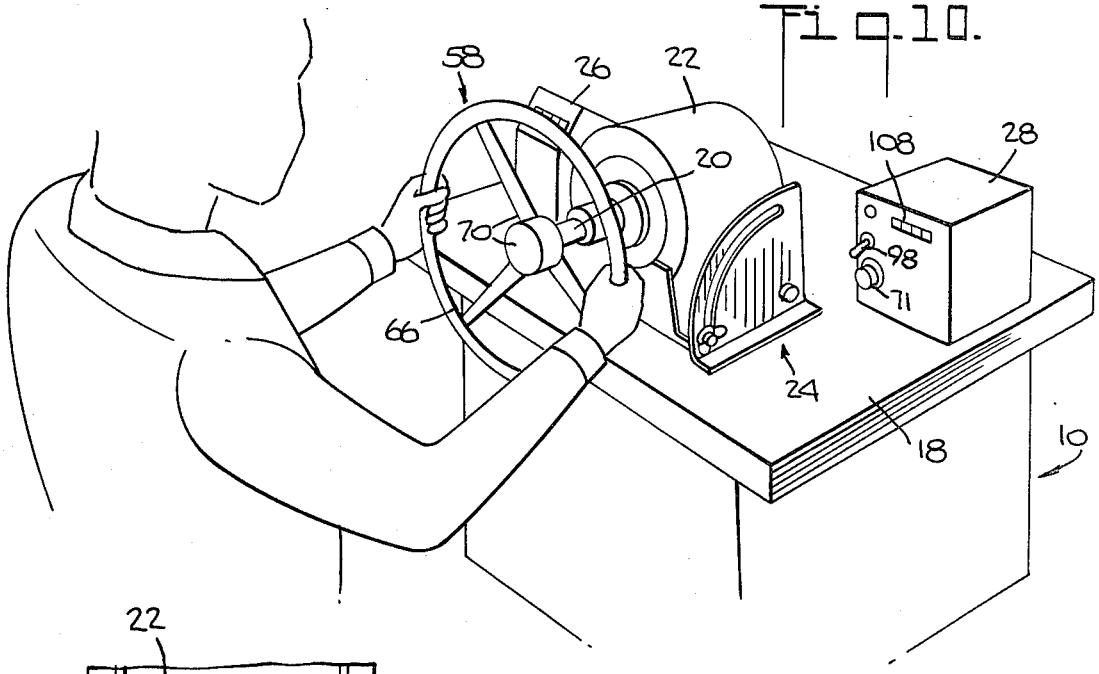
FIG. 10 is a perspective view of the embodiment of FIG. 1 and showing a wheel simulating accessory connected to a brake controlled shaft.

FIG. 10 illustrates the operation of the rehabilitation device as used with the large wheel accessory 58. As is shown in FIG. 1, the handle 66 of this accessory comprises a rim and its frame 70 comprises spokes and a hub with the coupler element 68 mounted on the hub. Thus, operation of the wheel turns the coupler element. This turning is communicated to the brake controlled shaft 20. The height table 10 and the angle of the shaft 20 can be adjusted to simulate the precise conditions encountered in handling the wheel of a large vehicle such as a truck or a bus.

Figure 11:
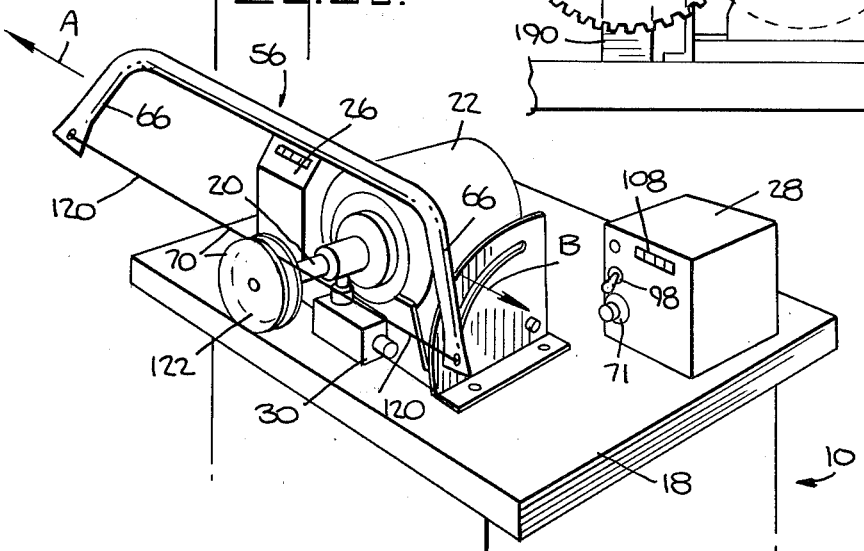
FIG. 11 is a view similar to FIG. 10 but showing a saw simulating accessory connected to a brake controlled shaft.

FIG. 11 illustrates the operation of the rehabilitation device as used with the saw accessory 56. As is shown in FIG. 1, this accessory includes handles 66 and a frame 70. The frame 70 further includes a length of wire 120 extending between the handles 66 and looped tightly around a pulley 122. The pulley in turn is provided at its center with a coupler element 68 (see FIG. 1) which, as described above, is connectable to the accessory coupler 32 on the brake controlled shaft 20. As shown in FIG. 11 the handles 66 are pulled back and forth in the direction of the arrows A and B in the ordinary manner of operation of a saw; and this movement is communicated by action of the frame 70, including the wire 120 and the pulley 122, to rotation of the coupler element. This rotation is communicated to the brake controlled shaft 20 which in turn provides controlled resistance to the movement of the handles so that they can simulate the operation of sawing.

FIGS. 12–14 illustrate the operation of the rehabilitation device as used with the pliers type squeezing accessory 36. As can be seen in these Figs., the accessory 36 comprises a pair of handles 66 connected by a frame 70 to a coupler element 68. The frame 70 in turn comprises upper and lower plier type jaws 70*a* and 70*b* and a pivot shaft 124 extending between them. The pivot shaft 124 is fixed to the upper plier jaw 70*a* but is freely rotatable relative to the lower plier jaw 70*b*. The inner end of the shaft 124 (extending toward the electrical brake 22) is attached to the coupler element 68; and, as shown in FIG. 14, this is connectable through a rachet connector 125 to the accessory coupler 32 as in the case of the other accessories.

A stabilizer bracket 126 is welded to the lower plier jaw 70*b* and it extends down therefrom. The bracket 126 has an inwardly extending lower flange 126*a* which is inserted into a flange support slot 128 formed by a flange housing 130 on the under side of the brake support bracket 82 (see FIG. 3).

When the pliers type squeezing accessory 36 is used as part of the rehabilitation device the lower flange 126*a* is fitted into the slot 128 in the flange housing 130 and the coupler element is connected to the accessory coupler 32. The handles 66 are then gripped and squeezed together. The bracket 126 holds the lower plier jaw 70*b* and the upper handle 66 stationary. Thus the squeezing action moves the lower handle 66 and the upper plier jaw 70*a*. This movement causes rotation of the pivot shaft 124 and the coupler element 68 which in turn rotates the brake controlled shaft 20. A spring (not shown) is provided to open the handles automatically after squeezing them together.

The rachet connector 125 is per se well known to the tool industry, and it provides a one way or racheting effect whereby rotational movements in one direction are communicated to the brake controlled shaft 20 but movements in the opposite direction are not communicated to the shaft. This arrangement is useful for the pliers type squeezing accessory where resistance to squeezing or closing of the handles must be provided while allowing freedom to opening of the handles. The rachet connector 125 may also be used with other accessories such as the push tool accessory 38, the wrench accessories 44 and 46 and the saw accessory 56.

Figure 15:
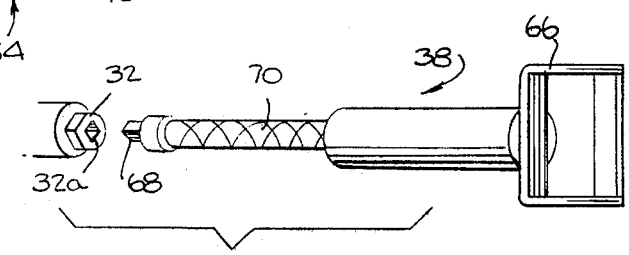
FIG. 15 is a view similar to FIG. 2 but showing a push tool accessory.

FIG. 15 shows the push tool accessory 38 which converts pushing movments to rotational movements. The accessory 38 is used by connecting its coupler element 68 through the rachet connector 125 to the accessory coupler 32 on the brake controlled shaft 20 and pushing the handle 66 axially of the shaft. The frame 70, which operates on the principle of a push type drill or screwdriver, converts this pushing motion to rotation and this rotation is opposed by the brake controlled shaft.

FIG. 17 shows in schematic fashion a hydraulically controlled brake system for use in the rehabilitation device of the present invention. As shown in FIG. 17 there is provided a positive displacement two-direction hydraulic pump 130 whose shaft is connected to, or forms part of, the brake controlled shaft 20. The pump 130 is connected via a pair of hydraulic lines 132 and 134 to a hydraulic reservoir 136. A check valve 138 is interposed along the lines 132 and 134, each check valve providing free flow in a direction toward the pump, but no flow in the opposite direction. The check valves are each bypassed by an adjustable pressure regulating valve 140. Also, a pressure gauge 139 is connected in each of the lines 132 and 134 between the pump 130 and the check valves 138.

When the shaft 20 is turned to rotate the pump shaft, the pump produces suction on one of the lines 132 or 134 and pressure on the other line. Free flow is permitted toward the pump along the line where suction exists but pressure builds up on the other line and no flow (and consequently no rotation of the pump shaft) takes place until the pressure in the pressure line has built up sufficiently to overcome the resistance of the pressure regulating valve 140 in the pressure line. It will be appreciated that by setting the pressure regulating valve 140, the amount of resistance to rotation of the pump shaft, and hence of the brake controlled shaft 20, can be set to any desired value.

FIG. 18 shows in schematic fashion a pneumatically controlled brake system for use in the rehabilitation device of the present invention. As shown in FIG. 18 there is provided an air pressure controlled brake 142 connected to the brake controlled shaft 20. This air pressure controlled brake 142 is per se known in the prior art and it provides a torque resistance to shaft rotation proportional to applied pneumatic pressure. An example of such an air pressure controlled brake (or "clutch" as it is also known) is the "Bel-Air" Clutch supplied by Scovill Corporation of Akron, Ohio.

An air input line 144 is connected from an air supply (not shown) through an adjustable pressure regulating valve 146, a surge tank 148, a bleed valve 150 and a pressure guage 152 a pressure input of the pressure controlled brake 142. By adjusting the regulating valve 146 the pressure applied to the brake 142 is adjusted to control the torque or shaft rotation resistance offered by the brake. The surge tank 148 serves to isolate the brake 142 from the effects of any pressure surges in the air supply. That bleed valve 150 may be used to reduce pressure in the line 144 and the pressure gauge 152 serves to provide a reading of the pressure and hence the torque or rotation resistance provided by the system.

FIG. 19 shows the construction of a mechanical controlled brake system for use in the rehabilitation device of the present invention. As shown in FIG. 19, there is provided a brake housing 160 of cylindrical configuration with a central opening 162 in a front wall 164 through which the brake controlled shaft 20 extends. A flat washer shaped stationary brake disk 166 is fixed to the inside surface of the front wall 164 around the opening 162. A rotatable member 168 comprising a flat disk portion 170 with a central opening 172 and a cup shaped portion 174 facing and abutting the central opening 172 is also provided inside the housing 160. A flat washer shaped rotatable brake disk 176 is fixed to the face of the disk portion 170 facing the stationary brake disk 166. The brake controlled shaft 20 extends through the central opening 172 of the rotatable member 168 and into the cup shaped portion 174. The brake controlled shaft 20 is also keyed to the rotatable member 168 as shown at 178 so that the rotatable member 168 turns with the shaft 20. The cup shaped portion 174 of the rotatable member 168 extends through and is guided by an opening 180 in a rear wall 182 of the housing 160. A lever support 184 is mounted on the outside of the rear wall 182 and this support has a pivot 186 which provides a fulcrum for an elongated rearwardly extending lever 188. The lever 188 is provided with notches 190 along its length; and a weight 192, which is moveable along the length of the lever 188, has a detent 193 to fit into the notches to maintain the weight at a fixed distance from the fulcrum pivot 186. An abutment 188*a*, on the forward end of the lever 188, extends against and abuts the back surface of the cup shaped portion 174 of the rotatable member 168.

In operation of the mechanical brake shown in FIG. 19, the shaft 20 rotates, and through the key 178, it turns the rotatable member 168 inside the housing 160. This rotation however is resisted by the friction between the stationary and rotatable brake disks 166 and 176. The friction between these brake disks, in turn, is controlled by the force with which they are pressed together. This pressing force is obtained by producing a downward force on the lever 188, causing it to pivot about the fulcrum pivot 186 so that its abutment 188*a* presses against the back surface of the cup shaped portion 174 of the rotatable member 168 to force the rotatable member against the stationary brake disk 166. The amount of this force is adjusted by adjustment of the position of the weight 192 along the lever 188.

Figure 20:
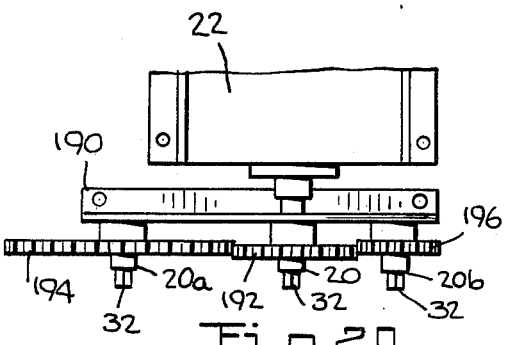
FIG. 20 is a top view of a multiple shaft torque resistance extending mechanism for use with the apparatus of FIG. 1.
Figure 21:
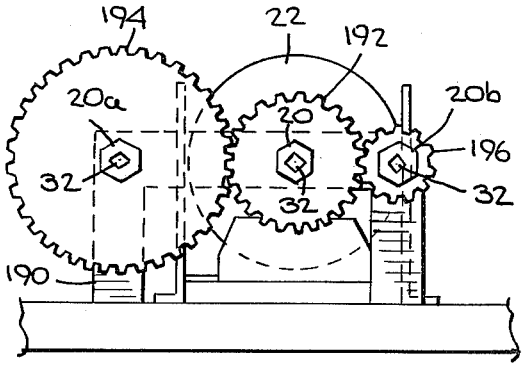
FIG. 21 is a front elevational view of the mechanism of FIG. 20.

FIGS. 20 and 21 show a modification to extend the torque range of the shaft brake 22. As shown in these drawings there are provided, in addition to the brake controlled shaft 20, a high torque resistance brake controlled shaft 20*a* and a low torque resistance brake controlled shaft 20*b*. These shafts extend parallel to the main brake controlled shaft 22 and they are each provided on their ends with an accessory coupler 32. The various accessories can thus be mounted on any of the shafts 20, 20*a* or 20*b*.

The shafts 20*a* and 20*b* are supported on the table 10 by means of a bracket 190. The shaft 20 is fitted with a drive gear 192 and each of the shafts 20*a* and 20*b* is fitted with a driven gear 194 and 196, respectively, each of which meshes with the drive gear 192. The driven gear 194 on the high torque resistance brake controlled shaft 20*a* is larger than the drive gear 192 so that an accessory mounted on the shaft 20*a* is resisted by a lower torque that would be provided if that accessory were mounted on the main brake controlled shaft 20. On the other hand, the driven gear 196 on the low torque resistance brake controlled shaft, is smaller than the drive gear 192 so that an accessory mounted on the shaft 20*b* is resisted by a higher torque than would be provided if that accessory were mounted on the main brake controlled shaft 20. It will be appreciated that with the arrangement shown in FIGS. 20 and 21 the range of torque resistance provided by the brake 22 can effectively be extended by mounting accessories on different ones of the shafts 20, 20*a* and 20*b*. This is particularly advantageous where one may wish at one time to simulate a small tool such as a key which requires very low torque resistance and at another time to simulate a large wrench which requires high torque resistance.

It will be seen from the foregoing that with the present invention the operational conditions of a large number of complex movements required in various industrial occupations may be simulated in a safe, efficient and inexpensive manner so that a patient may undergo therapy specifically suited not only to the nature of his injury but also to prepare him for his own type of work.

The use of the various accessories as described herein permits a patient not merely to exercise a specific muscle or joint in a particular direction, but more importantly it enables him simultaneously to carry out, in coordinated fashion, several muscle and joint movements. Because different muscle and joint movements are carried out simultaneously and in combination their interaction can be analyzed. Thus the present invention is useful for diagnosis as well as therapy.

It has also been found that nearly all limb, joint and muscle movements and combinations thereof used in industry are carried out in the operation of the various accessories described herein. In most cases a particularly complicated type of activity can be separated into a series of successive limb, joint and muscle movement combinations each of which are simulated by operation of one or another of the accessories described herein. Thus the range of utility of the present invention extends well beyond the various specific accessories described herein.

Having thus described the invention with particular reference to the preferred forms thereof, it will be obvious to those skilled in the art to which the invention pertains, after understanding the invention, that various changes and specifications may be made therein without departing from the spirit and scope of the invention as defined by the claims appended hereto.

What is claimed and desired to be secured by Letters Patent:

1. Apparatus for simulating the operation characteristics of different tools for rehabilitation of damaged limbs to use such tools, said apparatus comprising:

(a) a plurality of accessories of different sizes and configurations, each accessory having at least one handle of the size and shape of the handle of a tool being simulated;

(b) a coupler element;

(c) frame means interconnecting the handle to the coupler element in a manner such that movement of the handle through the path of movement of the tool handle being simulated produces rotation of the coupler element, the frame means for each accessory being different according to the tool being simulated and a coupler element of each accessory being of the same construction;

(d) a brake controlled shaft mounted for rotation about a fixed axis;

(e) a brake arranged to produce a predetermined resistance to rotation of the shaft;

(f) a cooperative accessory coupler on one end of the shaft to receive the coupler elements of the accessories, to support the accessories, and to communicate their movements to the shaft, the coupler element of each accessory being removably connectable to the accessory coupler such that the accessory is supported by the shaft; and (g) the shaft and brake being mounted on a bracket extending between a pair of side plates, with a pivot shaft extending between the side plate and through the bracket, the side plates having aligned, curved slots therein with their axes of curvature coincident with the pivot shaft, and clamping bolts extending through the bracket and the slots.

2. Apparatus for simulating the operation characteristics of different tools for rehabilitation of damaged limbs to use such tools, said apparatus comprising:

(a) a plurality of accessories of different sizes and configurations, each accessory having at least one handle of the size and shape of the handle of a tool being simulated;

(b) a coupler element;

(c) frame means interconnecting the handle to the coupler element in a manner such that movement of the handle through the path of movement of the tool handle being simulated produces rotation of the coupler element, the frame means for each accessory being different according to the tool being simulated and a coupler element of each accessory being of the same construction;

(d) a brake controlled shaft mounted for rotation about a fixed axis;

(e) a brake arranged to produce a predetermined resistance to rotation of the shaft;

(f) a cooperative accessory coupler on one end of the shaft to receive the coupler elements of the accessories, to support the accessories, and to communicate their movements to the shaft, the coupler element of each accessory being removably connectable to the accessory coupler such that the accessory is supported by the shaft; and (g) at least one of said tool simulator accessories being selected from the group consisting of a plyers simulating accessory, a key simulating accessory, a saw handle, and a frame which converts pushing movement on its handle to rotational movement of its coupler element.

3. An apparatus according to claim 2 wherein said accessory is a pliers simulating accessory having a pair of handles, a coupler element for connection to said brake controlled shaft, and a frame for converting squeezing movement of said handles to turning of said coupler element, the frame comprising a pair of plier jaws connected, respectively, to the handles, a shaft interconnecting the jaws and attached to the coupler element, the shaft being fixed to one of the jaws and freely rotatable to the other jaw and arranged to maintain the other jaw rotationally fixed when the coupler element is connected to the brake controlled shaft.

4. An apparatus according to claim 2, wherein the accessory includes a key simulating accessory comprising a key handle, a coupler element for attachment to the brake controlled shaft, and a frame interconnecting the key handle and the coupler element such that turning of the key handle produces rotation of the coupler element.

5. An apparatus according to claim 2, wherein the accessory includes a saw handle, a coupler element and a frame, the frame including a pulley having the coupler element attached at its center and a wire wound around the pulley and connected to the handle, whereby movement of the handle in a sawing direction causes rotation of the pulley and coupler element.

6. An apparatus according to claim 2, wherein the accessory includes a frame which converts pushing movement on its handle to rotational movement of its coupler element.

* * * * *

UNITED STATES PATENT AND TRADEMARK OFFICE

CERTIFICATE OF CORRECTION

PATENT NO. : 4,337,050

DATED : June 29, 1982

INVENTOR(S) : John Engalitcheff, Jr.

It is certified that error appears in the above—identified patent and that said Letters Patent is hereby corrected as shown below:

In the abstract: Line 6, the word "operatin" should be --- operation ---.

Claim 2(g), line 2: "plyers" should be --- pliers ---.

Signed and Sealed this

Twenty-first Day of September 1982

[SEAL]

Attest:

GERALD J. MOSSINGHOFF

Attesting Officer

Commissioner of Patents and Trademarks